US010724373B2

(12) United States Patent
Inagaki et al.

(10) Patent No.: US 10,724,373 B2
(45) Date of Patent: Jul. 28, 2020

(54) VANE OIL PUMP WITH DIFFERENT BACK PRESSURE SUPPLIED TO VANES

(71) Applicants: TOYOTA JIDOSHA KABUSHIKI KAISHA, Toyota-shi, Aichi-ken (JP); AISIN AW CO., LTD., Anjo-shi, Aichi-ken (JP)

(72) Inventors: Takafumi Inagaki, Toyota (JP); Yoshinobu Soga, Toyota (JP); Shuji Moriyama, Nagakute (JP); Yusuke Ohgata, Miyoshi (JP); Yuji Hattori, Ichinomiya (JP); Kazumichi Tsukuda, Okazaki (JP); Akihiko Noborio, Tokai (JP)

(73) Assignees: TOYOTA JIDOSHA KABUSHIKI KAISHA, Toyota (JP); AISIN AW CO., LTD., Anjo (JP)

( * ) Notice: Subject to any disclaimer, the term of this patent is extended or adjusted under 35 U.S.C. 154(b) by 254 days.

(21) Appl. No.: 15/793,550

(22) Filed: Oct. 25, 2017

(65) Prior Publication Data

US 2018/0128107 A1 May 10, 2018

(30) Foreign Application Priority Data

Nov. 4, 2016 (JP) ..... 2016-216703

(51) Int. Cl.
*F01C 21/08* (2006.01)
*F04C 2/344* (2006.01)
(Continued)

(52) U.S. Cl.
CPC ..... *F01C 21/0836* (2013.01); *F01C 21/0863* (2013.01); *F04C 2/348* (2013.01);
(Continued)

(58) Field of Classification Search
CPC .... F01C 21/0863; F04C 2/3446; F04C 2/348; F04C 15/066; F04C 2/344; F04C 14/26;
(Continued)

(56) References Cited

U.S. PATENT DOCUMENTS 4,183,723 A * 1/1980 Hansen ..... F04C 14/02 417/204
7,389,640 B2 * 6/2008 Muller ..... F16D 25/123 60/430
(Continued)

FOREIGN PATENT DOCUMENTS

CN 105909512 A 8/2016
JP S39-21474 Y 7/1964
(Continued)

OTHER PUBLICATIONS

Partial English-Language Translation of Jan. 21, 2020 Office Action issued in Japanese Patent Application No. 2016-216703.

*Primary Examiner* — Deming Wan
(74) *Attorney, Agent, or Firm* — Oliff PLC

(57) ABSTRACT

A vane oil pump includes a rotor including a plurality of slits, a housing having an inner circumferential cam surface such that a first pump unit and a second pump unit taking in and discharging oil in accordance with rotation of the rotor are separately disposed in a rotational direction of the rotor, a plurality of vanes respectively fitted in the slits of the rotor, and a pressure adjusting device configured to adjust a second discharge pressure of the second pump unit to a lower pressure than a first discharge pressure of the first pump unit. A back pressure groove is disposed on the housing and is provided to supply back pressure oil to a bottom portion of each slit.

3 Claims, 6 Drawing Sheets

(51) Int. Cl.

| | |
|---|---|
| ***F04C 2/348*** | (2006.01) |
| ***F04C 15/06*** | (2006.01) |
| ***F04C 14/26*** | (2006.01) |
| ***F04C 14/24*** | (2006.01) |
| ***F04C 14/06*** | (2006.01) |
| ***F04C 18/344*** | (2006.01) |
| ***F04C 15/00*** | (2006.01) |

(52) U.S. Cl.
CPC ..... *F04C 2/3446* (2013.01); *F04C 15/0076* (2013.01); *F04C 15/066* (2013.01); *F04C 2210/206* (2013.01); *F04C 2240/20* (2013.01); *F04C 2240/30* (2013.01)

(58) Field of Classification Search
CPC .... F04C 14/06; F04C 14/24; F04C 2270/585; F04C 2270/185; F04C 18/3446
See application file for complete search history.

(56) References Cited

U.S. PATENT DOCUMENTS

| | | | | |
|---|---|---|---|---|
| 2014/0294650 | A1* | 10/2014 | Fujita | F04C 2/3446 418/269 |
| 2015/0075154 | A1* | 3/2015 | Wi | F16H 61/0025 60/464 |
| 2016/0245286 | A1 | 8/2016 | Senbongi et al. | |
| 2017/0184106 | A1 | 6/2017 | Nishikawa | |

FOREIGN PATENT DOCUMENTS

| | | | | |
|---|---|---|---|---|
| JP | WO 2005-005837 | * | 3/2003 | F04C 2/344 |
| JP | 2006-336592 | A | 12/2006 | |
| JP | 2015-203385 | A | 11/2015 | |
| JP | 2017-115845 | A | 6/2017 | |

* cited by examiner

VANE OIL PUMP WITH DIFFERENT BACK PRESSURE SUPPLIED TO VANES

INCORPORATION BY REFERENCE

The disclosure of Japanese Patent Application No. 2016-216703 filed on Nov. 4, 2016 including the specification, drawings and abstract is incorporated herein by reference in its entirety.

BACKGROUND

1. Technical Field

The present disclosure relates to a vane oil pump having a pair of first and second pump units, and relates particularly to a technology that reduces torque loss caused by sliding friction between a vane tip end and an inner circumferential cam surface.

2. Description of Related Art

A vane oil pump having (a) a housing that has an inner circumferential cam surface, (b) a rotor that is rotatably disposed inside the housing and has an outer circumferential surface facing the inner circumferential cam surface, (c) a plurality of vanes that is respectively fitted in a plurality of slits disposed to be open on the outer circumferential surface of the rotor and is radially disposed to be advanceable and retractable in the radial direction of the rotor such that the tip end portion of each vane protrudes from each slit, and (d) a back pressure groove that is disposed on the housing such that back pressure oil for pressing the tip end portion of each vane to the inner circumferential cam surface can be supplied to the bottom portion of each slit is known (refer to Japanese Unexamined Patent Application Publication No. 2006-336592 (JP 2006-336592 A)). A vane oil pump in which (e) the diameter dimension of the inner circumferential cam surface from the rotational axis of a rotor is set to increase or decrease such that a pair of first and second pump units taking in and discharging oil in accordance with rotation of the rotor is separately disposed in the rotational direction of the rotor and (f) a second discharge pressure of the second pump unit is adjusted to a lower pressure than a first discharge pressure of the first pump unit is suggested in Japanese Unexamined Patent Application Publication No. 2015-203385 (JP 2015-203385 A).

SUMMARY

In such a vane oil pump, a back pressure (the hydraulic pressure of the back pressure oil) presses the vanes to the inner circumferential cam surface. Thus, when the back pressure is high, torque loss caused by sliding friction between the vanes and the inner circumferential cam surface is increased. When the back pressure is low, the amount of oil leaking from a gap between the vanes and the inner circumferential cam surface is increased, and pump efficiency may be decreased.

The present disclosure reduces a decrease in pump efficiency due to leakage of oil and reduces torque loss caused by sliding friction between vanes and an inner circumferential cam surface due to a back pressure.

An aspect of the present disclosure relates to a vane oil pump including: a rotor including a plurality of slits open on an outer circumferential surface of the rotor; a housing having an inner circumferential cam surface, the housing accommodating the rotor inside the housing such that the outer circumferential surface of the rotor faces the inner circumferential cam surface, the housing being configured to allow rotation of the rotor with respect to the housing, the inner circumferential cam surface of the housing being configured to have a diameter dimension from a rotational axis of the rotor, and the diameter dimension being configured to increase or decrease in a rotational direction of the rotor such that a first pump unit and a second pump unit taking in and discharging oil in accordance with rotation of the rotor are separately disposed in the rotational direction of the rotor; a plurality of vanes respectively fitted in the slits of the rotor, a tip end portion of each vane being radially disposed to protrude from the opening of each slit of the rotor, and the vanes being configured to advance or retract with respect to the slits in a radial direction of the rotor; and a pressure adjusting device configured to adjust a second discharge pressure of the second pump unit to a lower pressure than a first discharge pressure of the first pump unit. A back pressure groove is disposed on the housing. The back pressure groove is provided to supply back pressure oil to a bottom portion of each slit such that the tip end portion of each vane is pressed to the inner circumferential cam surface. The back pressure groove is provided such that the back pressure oil supplied to the bottom portion of each slit corresponding to an oil discharge part of the second pump unit has a lower pressure than the back pressure oil supplied to the bottom portion of each slit corresponding to an oil discharge part of the first pump unit when the second discharge pressure is adjusted to a lower pressure than the first discharge pressure.

According to the aspect, a pressing force that presses the vanes to the inner circumferential cam surface is affected by not only a back pressure generated by the back pressure oil but also a centrifugal force acting on the vanes, an intake negative pressure of oil, a discharge pressure of oil, and the like. The intake negative pressure is added in an oil intake part, and the discharge pressure is subtracted in an oil discharge part. The present disclosure is conceived in view of a difference in pressing force between each part of a pump unit. In an oil intake part of the first pump unit where the pressing force is increased by the intake negative pressure, second discharged oil having a comparatively low pressure is supplied as the back pressure oil from a second back pressure groove. Thus, the pressing force is decreased, and torque loss caused by sliding friction between the vanes and the inner circumferential cam surface is reduced. In the oil discharge part of the first pump unit where the pressing force is decreased by the discharge pressure, first discharged oil having a comparatively high pressure is supplied as the back pressure oil from a first back pressure groove. Thus, the vanes are pressed to the inner circumferential cam surface at an appropriate pressing force regardless of the discharge pressure. Therefore, leakage of oil is reduced, and a predetermined pump efficiency can be secured.

In the vane oil pump according to the aspect, the back pressure groove may include the first back pressure groove into which the first discharged oil of the first pump unit having the first discharge pressure is introduced, and the second back pressure groove into which second discharged oil of the second pump unit having the second discharge pressure is introduced. The first back pressure groove may be provided to supply the back pressure oil to the bottom portion of each slit corresponding to the oil discharge part of the first pump unit. The second back pressure groove may be provided to supply the back pressure oil to the bottom portion of each slit corresponding to the entirety of the second pump unit and the oil intake part of the first pump unit.

In the vane oil pump according to the aspect, the back pressure groove may be provided to supply the back pressure oil to the bottom portion of each slit corresponding to the oil discharge part of the first pump unit.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Figure 1:
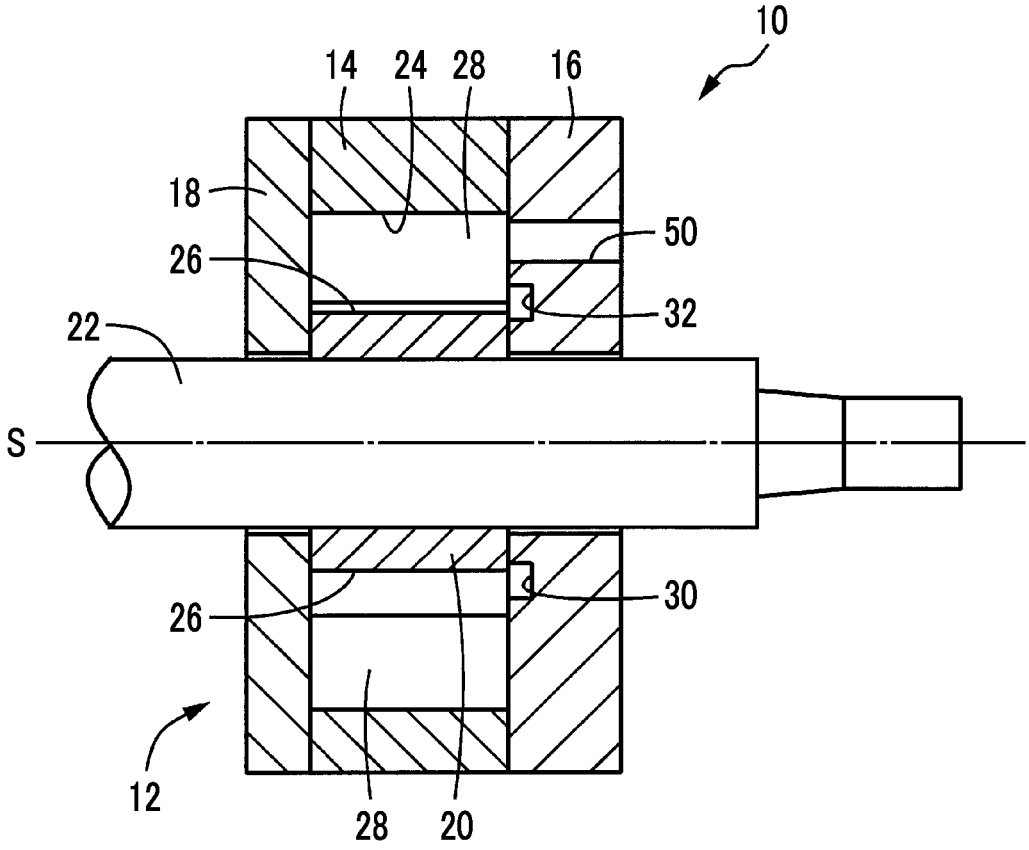
FIG. 1 is a diagram illustrating a configuration of a vane oil pump that is one embodiment of the present disclosure, and is a sectional view of a part taken along the arrow I-I in FIG. 2.

A vane oil pump of the present disclosure is used as a hydraulic pressure source that supplies oil to, for example, a hydraulic actuator or a lubricated part of a vehicle. A rotor is rotationally driven mechanically by a traveling drive source such as an engine. The rotor can be rotationally driven mechanically by being joined to a rotating member other than the traveling drive source or can be rotationally driven by using an electric motor for driving a pump. The vane oil pump can be used as a hydraulic pressure source for a hydraulic control device for other than a vehicle.

A second back pressure groove is desirably disposed to supply second discharged oil as back pressure oil in the entirety of a second pump unit and an oil intake part of a first pump unit. In such a case, a pressing force acting on vanes is decreased in the entirety of the second pump unit, and torque loss caused by sliding friction between the vanes and an inner circumferential cam surface is reduced. The present disclosure can be embodied in various forms. For example, oil having a different hydraulic pressure from the second discharged oil can be supplied as the back pressure oil to the second pump unit by disposing a third separate back pressure groove that supplies the back pressure oil to the second pump unit. A back pressure groove may not be provided in the second pump unit and may be provided to supply the back pressure oil to the bottom portion of each slit corresponding to the oil discharge part of the first pump unit.

An embodiment of the present disclosure is configured such that, for example, (a) the inner circumferential cam surface has an elliptic shape about the center line of the vane oil pump matching the axial center of the rotor, and the diameter dimension of the inner circumferential cam surface from the center line is periodically changed at a cycle of 180°, and that (b) the first pump unit and the second pump unit have the same pumping capability and are symmetrically disposed with the rotor interposed therebetween such that each of the first pump unit and the second pump unit takes in and discharges oil in half rotation of the rotor. The first pump unit and the second pump unit may not be configured to have the same pumping capability. Examples of various available forms include setting different angular ranges for the first pump unit and the second pump unit and setting a different amount of change in the diameter dimension of the inner circumferential cam surface. A third pump unit can be disposed in addition to the first pump unit and the second pump unit.

A hydraulic control device to which the vane oil pump is connected as a hydraulic pressure source includes a pressure adjusting valve that has an increasing cross-sectional area of flow and mechanically drains the second discharged oil output from the second pump unit based on a first discharge pressure when, for example, the rotational speed of the rotor exceeds a predetermined setting value. The hydraulic control device is configured such that the pressure adjusting valve adjusts the second discharge pressure to a lower pressure than the first discharge pressure. A non-return valve that permits flow of oil from a second oil discharge passage to a first oil discharge passage and prevents flow of oil from the first oil discharge passage to the second oil discharge passage, can be disposed between the first oil discharge passage to which first discharged oil is supplied and the second oil discharge passage to which the second discharged oil is supplied, thereby maintaining the second discharge pressure at the first discharge pressure or lower at all times. The first discharge pressure and the second discharge pressure may be adjusted by individual electromagnetic valves or the like. Thus, the vane oil pump is used in various hydraulic control devices. The second discharge pressure may not be adjusted to a lower pressure than the first discharge pressure at all times. The second discharge pressure may be adjusted to a lower pressure than the first discharge pressure under at least a certain condition.

Hereinafter, an embodiment of the present disclosure will be described in detail with reference to the drawings. In the following embodiment, the drawings are appropriately simplified or modified for description, and the dimensional ratio, the shape, and the like of each unit may not be accurately drawn.

Figure 2:
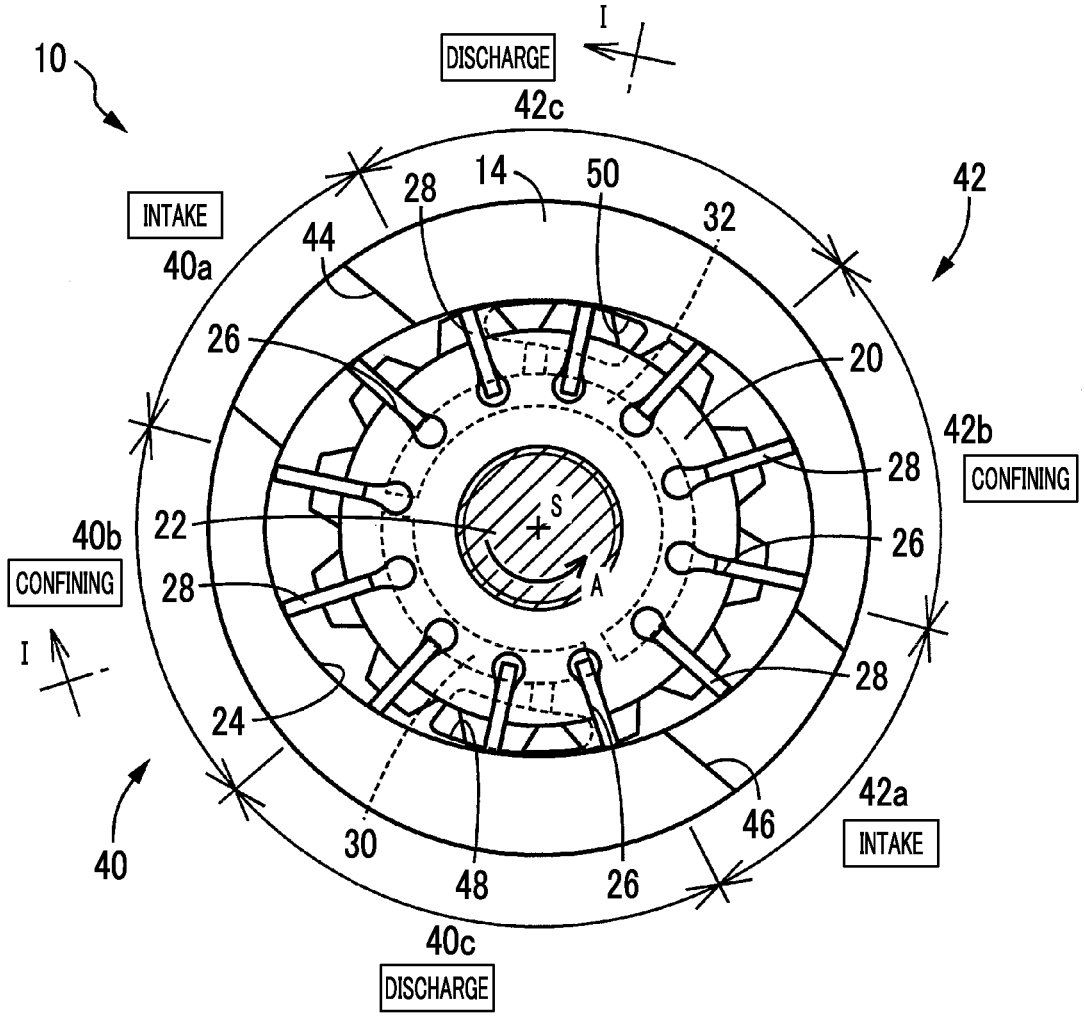
FIG. 2 is a front view of the vane oil pump in FIG. 1 without a pump cover.

FIG. 1 is a diagram illustrating a configuration of a vane oil pump 10 that is one embodiment of the present disclosure, and is a sectional view of a part taken along the arrow I-I in FIG. 2. The vane oil pump 10 includes a cylindrical cam ring 14, a side plate 16, and a pump cover 18 constituting a housing 12, and a rotor 20 accommodated inside the cam ring 14. The side plate 16 and the pump cover 18 have circular plate shapes that have an outer diameter approximately equal to the outer diameter of the cam ring 14. The side plate 16 and the pump cover 18 are concentrically disposed with the cam ring 14 interposed therebetween and are integrated with each other by a fastening bolt or the like. The side plate 16 and the pump cover 18 are fixed to a transmission case or the like not illustrated. The rotor 20 has a cylindrical shape and is disposed rotatably and concentrically with the side plate 16 and the pump cover 18 in an accommodation space between the side plate 16 and the pump cover 18. The rotor 20 is concentrically joined to a pump shaft 22 by spline fitting or the like that does not allow relative rotation therebetween. The pump shaft 22 is rotationally driven by a predetermined rotational drive source such as a drive source for vehicle traveling or an electric motor. Thus, the rotor 20 is rotated along with the pump shaft 22. Insert holes through which the pump shaft 22 is inserted are disposed in the central parts of the side plate 16 and the pump cover 18. The axial center of the pump shaft 22, that is, the rotational axis of the rotor 20, matches a center line S of the vane oil pump 10. The cam ring 14 and the side plate 16 may be integrated with each other.

Figure 3:
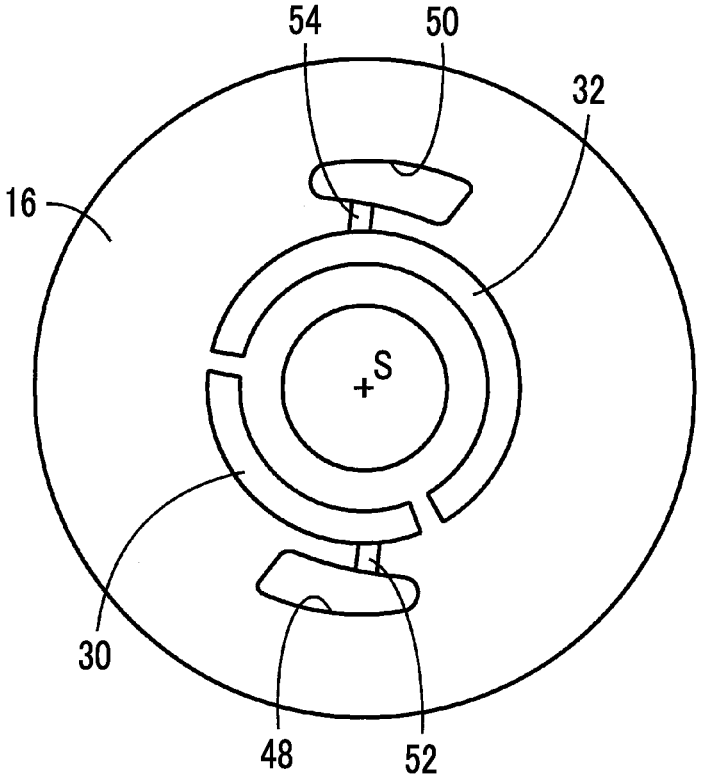
FIG. 3 is a front view illustrating solely a side plate of the vane oil pump in FIG. 1.

FIG. 2 is a front view of the vane oil pump 10 without the pump cover 18. FIG. 3 is a front view illustrating solely the side plate 16. The inner circumferential surface of the cam ring 14 is an inner circumferential cam surface 24 of which the diameter dimension from the center line S increases or decreases in the circumferential direction of the cam ring 14. A plurality (12 in the embodiment) of slits 26 is disposed in the rotor 20 in parallel with the center line S and is open on the outer circumferential surface of the rotor 20 facing the inner circumferential cam surface 24. Vanes 28 are fitted in the slits 26 such that the tip end portion of each vane 28 can protrude to the outside from each slit 26. The slits 26 are radially disposed at equiangular intervals about the center line S. The vanes 28 are radially disposed to be advanceable and retractable in the radial direction of the rotor 20. While the slits 26 are disposed in the radial direction of the rotor 20 passing the center line S in the present embodiment, the slits 26 can also be disposed slantwise about the center line S. An arrow A illustrated in the pump shaft 22 in FIG. 2 is the rotational direction of the pump shaft 22. The pump shaft 22 is rotationally driven counterclockwise in FIG. 2 in the present embodiment.

Figure 4:
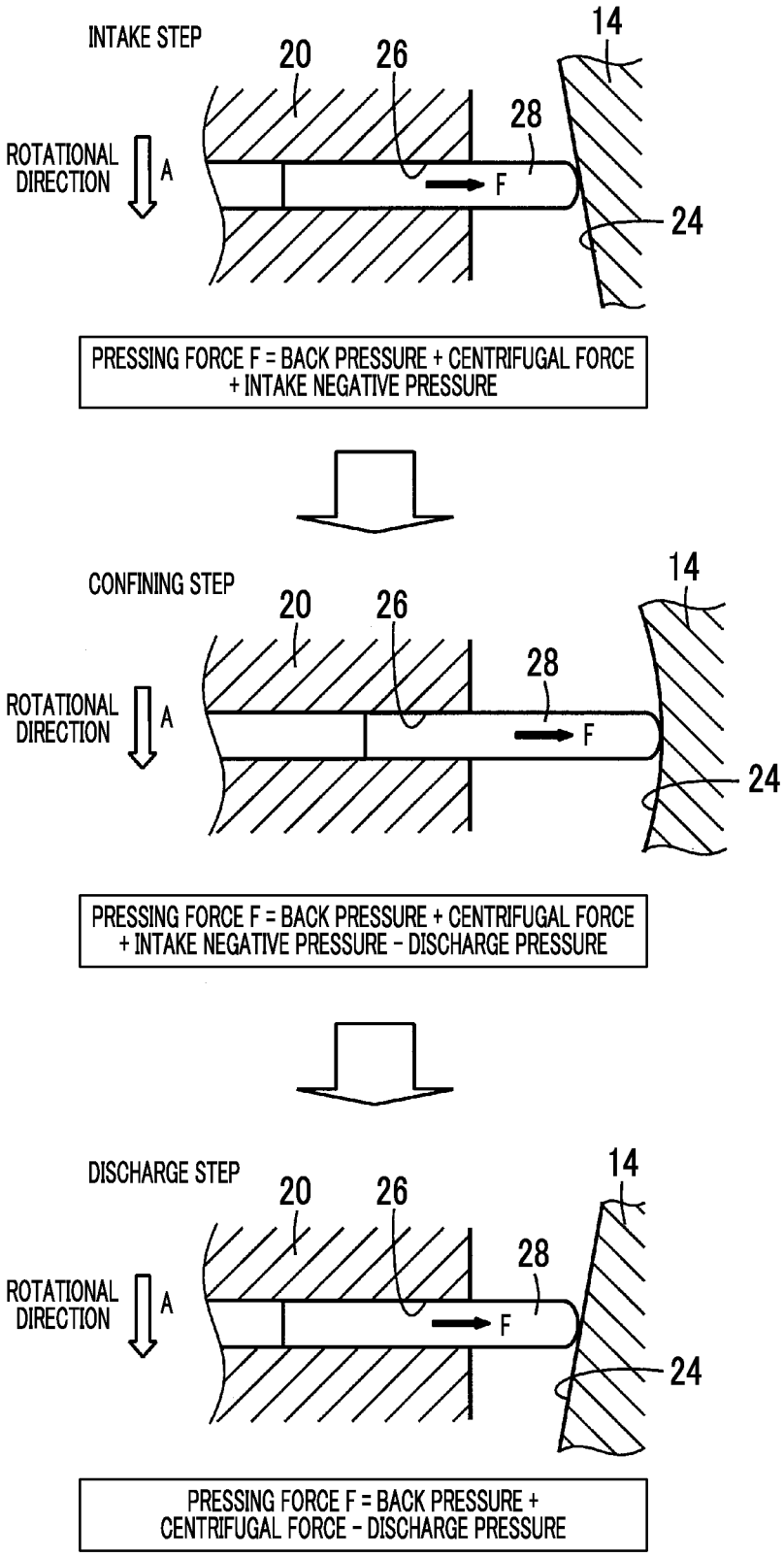
FIG. 4 is a diagram illustrating a difference in pressing force among an intake step, a confining step, and a discharge step of the vane oil pump in FIG. 1.

A pair of first and second back pressure grooves 30, 32 is disposed on the inner surface of the side plate 16 such that back pressure oil for pressing the tip end portion of each vane 28 to the inner circumferential cam surface 24 can be supplied to the bottom portion of each slit 26. The first back pressure groove 30 and the second back pressure groove 32 are disposed about the center line S in an arc shape having approximately the same diameter dimension as the bottom portion of each slit 26. Supplying the back pressure oil having a predetermined pressure to the bottom portion of each slit 26 exerts a back pressure to the vanes 28, and the tip end portion of each vane 28 is pressed to the inner circumferential cam surface 24 at a predetermined pressing force F (refer to FIG. 4). The depth dimension of each slit 26 is set such that a predetermined gap remains in the bottom portion thereof even in a state where the vanes 28 are pressed into the slits 26 by engaging with the inner circumferential cam surface 24. A circular hole having a diameter greater than the plate thickness of each vane 28 is disposed continuously with each slit 26 in the bottom portion of each slit 26. A predetermined back pressure is appropriately exerted across the total length of each vane 28 by supplying the back pressure oil into the circular hole.

Each vane 28 has a rectangular plate shape. Both end portions of each vane 28 in the direction of the center line S are respectively in sliding contact with the inner surfaces of the side plate 16 and the pump cover 18. Accordingly, when each vane 28 is pressed outward in the radial direction of the rotor 20 by the back pressure and has the tip end portion thereof pressed to the inner circumferential cam surface 24 of the cam ring 14, a plurality (12 in the present embodiment) of pump chambers is formed around the rotor 20 by the adjacent vanes 28, the inner circumferential cam surface 24, the outer circumferential surface of the rotor 20, and the inner surfaces of the side plate 16 and the pump cover 18. When the rotor 20 is rotationally driven about the center line S, each vane 28 advances or retracts in the radial direction of the rotor 20 in accordance with a change in the diameter dimension of the inner circumferential cam surface 24. Accordingly, the capacity of each pump chamber is increased or decreased, and a pumping action that takes in and discharges oil by an increase or a decrease in the capacity of each pump chamber is achieved. In the present embodiment, the inner circumferential cam surface 24 has an elliptic shape of which the diameter dimension is periodically changed at a cycle of 180° about the center line S. A pair of first and second pump units 40, 42 has the same pumping capability taking in oil in half rotation of the rotor 20 and discharging the oil in another half rotation of the rotor 20, and the first and second pump units 40, 42 are symmetrically (having a phase difference of 180°) disposed with the rotor 20 interposed therebetween. An oil intake part 40*a*, an oil confining part 40*b*, and an oil discharge part 40*c* on the left side of FIG. 2 relate to the first pump unit 40. An oil intake part 42*a*, an oil confining part 42*b*, and an oil discharge part 42*c* on the right side of FIG. 2 relate to the second pump unit 42.

The oil intake parts 40*a*, 42*a*, the oil confining parts 40*b*, 42*b*, and the oil discharge parts 40*c*, 42*c* are disposed in a positional relationship such that the oil intake parts 40*a*, 42*a* are on the upstream side of the direction of the arrow A, which is the rotational direction of the rotor 20, and that the oil discharge parts 40*c*, 42*c* are on the downstream side of the direction of the arrow A. As illustrated in an intake step in FIG. 4, the oil intake parts 40*a*, 42*a* are parts where the diameter dimension of the inner circumferential cam surface 24 gradually increases in the direction of the arrow A and where the vanes 28 protrude from the slits 26 in accordance with rotation of the rotor 20 and increase the capacity of each pump chamber. A first intake port 44 and a second intake port 46 for intake of oil from the outside are respectively disposed in the oil intake parts 40*a*, 42*a* of the first pump unit 40 and the second pump unit 42. The first intake port 44 and the second intake port 46 are configured as grooves disposed on a flat side surface of the cam ring 14. The grooves are closed by the pump cover 18 to form the first intake port 44 and the second intake port 46 that are open on the outer circumferential surface of the cam ring 14. A negative pressure generated by a change in the capacity of each pump chamber causes oil to be taken into each pump chamber from the outside. As illustrated in a confining step in FIG. 4, the oil confining parts 40*b*, 42*b* are parts where the increasing diameter dimension of the inner circumferential cam surface 24 starts to decrease in the direction of the arrow A and where the capacity of each pump chamber is hardly changed. As illustrated in a discharge step in FIG. 4, the oil discharge parts 40*c*, 42*c* are parts where the diameter dimension of the inner circumferential cam surface 24 gradually decreases in the direction of the arrow A and where the vanes 28 are pressed into the slits 26 in accordance with rotation of the rotor 20 and decrease the capacity of each pump chamber. A first discharge port 48 and a second discharge port 50 for discharge of oil to the outside are respectively disposed in the oil discharge parts 40*c*, 42*c* of the first pump unit 40 and the second pump unit 42. The first discharge port 48 and the second discharge port 50 are configured as through-holes disposed in the side plate 16. The oil in each pump chamber is discharged to the outside from the first discharge port 48 and the second discharge port 50 by a change in the capacity of each pump chamber.

As is apparent from FIG. 3, the first discharge port 48 communicates with the first back pressure groove 30 through a communicating passage 52. First discharged oil of the first pump unit 40 that is output from the first discharge port 48 and has a pressure adjusted to a first discharge pressure P1 is introduced as the back pressure oil into the first back pressure groove 30. The second discharge port 50 communicates with the second back pressure groove 32 through a communicating passage 54. Second discharged oil of the second pump unit 42 that is output from the second discharge port 50 and has a pressure adjusted to a second discharge pressure P2 is introduced as the back pressure oil into the second back pressure groove 32. The communicating passages 52, 54 are configured as grooves formed on the inner surface of the side plate 16. The inner surface of the side plate 16 is attached in close contact to a side surface of the rotor 20 to form an oil passage. The first back pressure groove 30 is disposed in an arc shape in the same angular range (for example, approximately 120°) as the oil confining part 40*b* and the oil discharge part 40*c* such that the first discharged oil can be introduced as the back pressure oil into the bottom portion of each slit 26 in the oil confining part 40*b* and the oil discharge part 40*c* of the first pump unit 40. The second back pressure groove 32 is disposed in an arc shape in the same angular range (for example, approximately 240°) as the entirety of the second pump unit 42 and the oil intake part 40*a* of the first pump unit 40 such that the second discharged oil can be introduced as the back pressure oil into the bottom portion of each slit 26 in the entirety of the second pump unit 42 and the oil intake part 40*a* of the first pump unit 40. The second back pressure groove 32 can be extended to the oil confining part 40*b* of the first pump unit 40, and the first back pressure groove 30 can be shortened to the oil discharge part 40*c* of the first pump unit 40.

Figure 5:
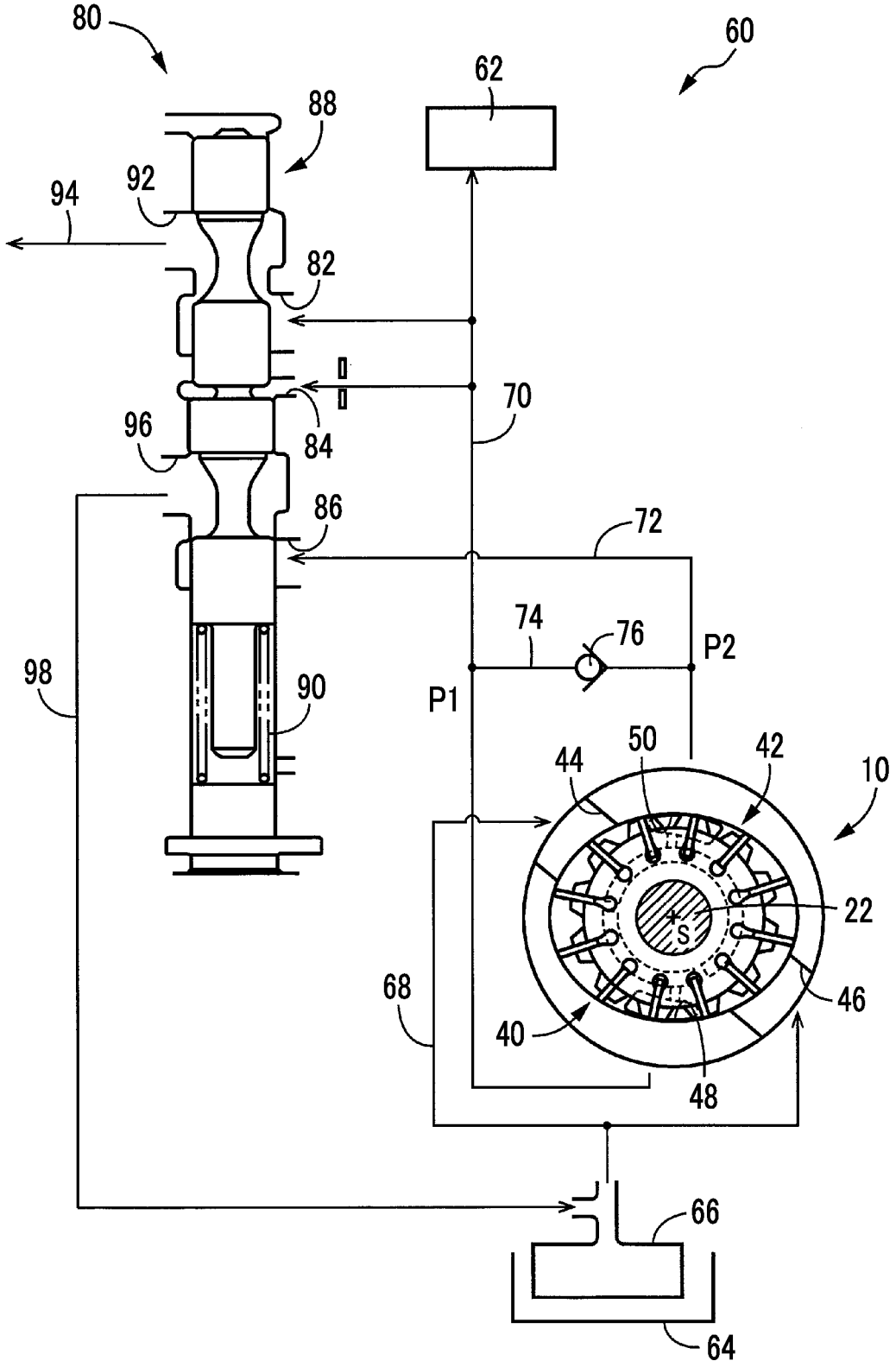
FIG. 5 is a hydraulic circuit diagram illustrating one example of a hydraulic control device in which the vane oil pump in FIG. 1 is used.

The vane oil pump 10 of the present embodiment is suitably used as a hydraulic pressure source for a hydraulic control device in which the second discharge pressure P2 of the second pump unit 42 is adjusted to a lower pressure than the first discharge pressure P1 of the first pump unit 40. A vehicle hydraulic control device 60 illustrated in FIG. 5 is one example of such a hydraulic control device. The hydraulic control device 60 supplies oil to an oiled part 62 and the like such as a hydraulic actuator and a lubricated part of an automatic transmission. The pump shaft 22 is joined to an engine not illustrated that is a drive source for vehicle traveling, and is rotationally driven mechanically in the direction of the arrow A. When the rotor 20 is rotationally driven along with the pump shaft 22, oil that is retained in an oil retaining unit 64, such as an oil pan, is taken into the first intake port 44 and the second intake port 46 from an oil intake passage 68 through a strainer 66 and is discharged to a first oil discharge passage 70 and a second oil discharge passage 72 from the first discharge port 48 and the second discharge port 50. The first oil discharge passage 70 and the second oil discharge passage 72 communicate with each other through a communicating oil passage 74. A non-return valve 76 that permits flow of oil from the second oil discharge passage 72 to the first oil discharge passage 70 and prevents flow of oil from the first oil discharge passage 70 to the second oil discharge passage 72 is disposed in the communicating oil passage 74.

The first oil discharge passage 70 supplies the first discharged oil discharged from the first pump unit 40 to the oiled part 62 and is connected to a first input port 82 and a feedback port 84 of a pressure adjusting valve 80. The second oil discharge passage 72 is connected to a second input port 86 of the pressure adjusting valve 80. The pressure adjusting valve 80 adjusts the first discharge pressure P1 that is the hydraulic pressure of the first discharged oil in the first oil discharge passage 70, and the second discharge pressure P2 that is the hydraulic pressure of the second discharged oil in the second oil discharge passage 72. The pressure adjusting valve 80 includes a spool 88 and a spring (compression coil spring) 90 that biases the spool 88 in a valve-closing direction, that is, upward in FIG. 5. The pressure adjusting valve 80 moves the spool 88 downward (in a valve-opening direction) to discharge the remaining oil in the first oil discharge passage 70 to an oil passage 94 from the first input port 82 through a first output port 92 such that the first discharge pressure P1 applied to the feedback port 84 and the spring 90 are balanced. That is, the first discharge pressure P1 is adjusted to an approximately constant controlled hydraulic pressure Pa that is set in accordance with the biasing force of the spring 90. The controlled hydraulic pressure Pa is appropriately set in accordance with a hydraulic pressure used for the oiled part 62.

When the spool 88 is moved downward in order to adjust the first discharge pressure P1 to the controlled hydraulic pressure Pa, the second input port 86 communicates with a second output port 96. Accordingly, the second discharged oil in the second oil discharge passage 72 is discharged to a returning oil passage 98 from the second input port 86 through the second output port 96 and returns to the oil intake passage 68, and the second discharge pressure P2 of the second oil discharge passage 72 is decreased. When the spool 88 is moved downward in FIG. 1 by the first discharge pressure P1 applied to the feedback port 84, communication between the first input port 82 and the first output port 92 and communication between the second input port 86 and the second output port 96 are opened in synchronization with each other. However, the shape and the like of each unit are set such that the cross-sectional area of flow (area of opening) between the second input port 86 and the second output port 96 is greater than the cross-sectional area of flow (area of opening) between the first input port 82 and the first output port 92. Accordingly, the second discharge pressure P2 is adjusted to a lower pressure than the first discharge pressure P1.

Figure 6:
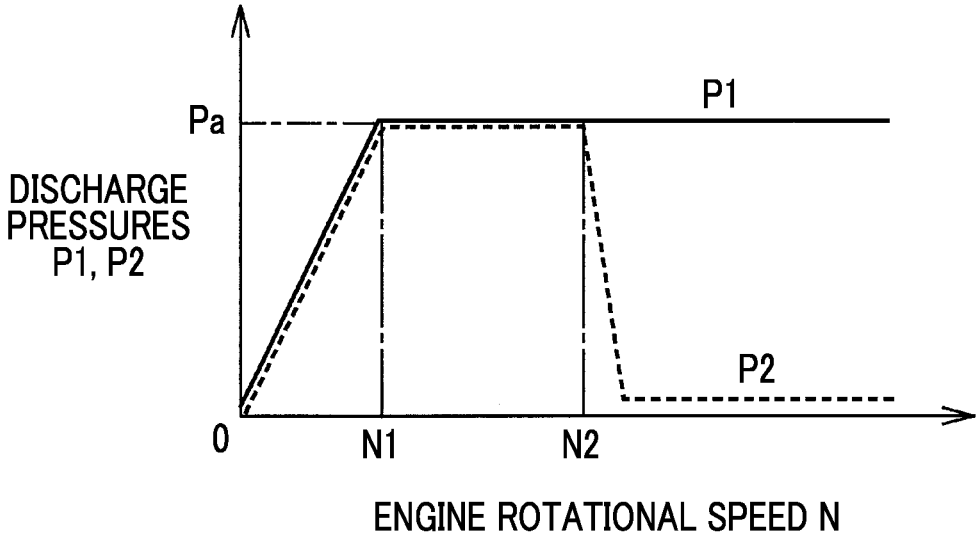
FIG. 6 is a graph illustrating characteristics of a first discharge pressure and a second discharge pressure when the vane oil pump in FIG. 1 is used in the hydraulic control device in FIG. 5.

FIG. 6 is a diagram illustrating hydraulic characteristics of the first discharge pressure P1 in the first oil discharge passage 70 and the second discharge pressure P2 in the second oil discharge passage 72 in the hydraulic control device 60. The hydraulic characteristics of the first discharge pressure P1 and the second discharge pressure P2 change in accordance with an engine rotational speed N that corresponds to the rotational speed of the rotor 20 of the vane oil pump 10, that is, the discharge flow rate. In a state where the first discharge pressure P1 of the first discharged oil discharged to the first oil discharge passage 70 from the first pump unit 40 does not reach the controlled hydraulic pressure Pa at slow rotation of the rotor 20 with the engine rotational speed N lower than N1, the biasing force of the spring 90 in the valve-closing direction is greater than the biasing force in the valve-opening direction applied to the spool 88 of the pressure adjusting valve 80 by the first discharge pressure P1 input at the feedback port 84. Communication between the first input port 82 and the first output port 92 and communication between the second input port 86 and the second output port 96 are closed. At this point, the first discharge pressure P1 of the first oil discharge passage 70 connected to the oiled part 62 is lower than the second discharge pressure P2, and the non-return valve 76 is opened to cause the second discharged oil in the second oil discharge passage 72 to flow into the first oil discharge passage 70. Thus, the first discharge pressure P1 becomes approximately the same as the second discharge pressure P2, and a rise in the first discharge pressure P1 is prompted.

When the vane oil pump 10 is started, the first discharged oil having the first discharge pressure P1 and the second discharged oil having the second discharge pressure P2, both of which have the same pressure, are supplied as the back pressure oil to each vane 28 respectively through the first back pressure groove 30 and the second back pressure groove 32. Accordingly, the back pressure or the like generated by the back pressure oil presses the tip end portion of each vane 28 to the inner circumferential cam surface 24 at the predetermined pressing force F. Thus, oil is discharged at a predetermined pump efficiency, and responsiveness to a rise in hydraulic pressure is secured.

When the engine rotational speed N is higher than or equal to N1 and lower than N2, the biasing force of the spring 90 in the valve-closing direction and the biasing force in the valve-opening direction that is applied to the spool 88 and corresponds to the first discharge pressure P1 input at the feedback port 84 are balanced. Accordingly, communication between the first input port 82 and the first output port 92 is opened or closed such that the first discharge pressure P1 becomes equal to the controlled hydraulic pressure Pa set in accordance with the biasing force of the spring 90. At the same time, communication between the second input port 86 and the second output port 96 is opened or closed in synchronization with the opening or closing of communication between the first input port 82 and the first output port 92. The opening or closing of communication between the second input port 86 and the second output port 96 causes the oil in the second oil discharge passage 72 to return through the returning oil passage 98. The flow of oil from the second oil discharge passage 72 to the first oil discharge passage 70 through the communicating oil passage 74 is permitted. Thus, the second discharge pressure P2 is maintained at the controlled hydraulic pressure Pa that is approximately the same as the first discharge pressure P1.

When the engine rotational speed N is higher than or equal to N2, the first oil discharge passage 70 has a sufficient discharge flow rate for adjusting the first discharge pressure P1 to the controlled hydraulic pressure Pa. Thus, the amount of movement of the spool 88 in the valve-opening direction is increased in accordance with the discharge flow rate of the first oil discharge passage 70 that increases in proportion to a rise in the rotational speed of the rotor 20. Accordingly, both the flow rate from the first oil discharge passage 70 to the oil passage 94 and the flow rate from the second oil discharge passage 72 to the returning oil passage 98 are increased. Communication between the first input port 82 and the first output port 92 is synchronized with communication between the second input port 86 and the second output port 96, and the cross-sectional area of flow between the second input port 86 and the second output port 96 is greater than the cross-sectional area of flow between the first input port 82 and the first output port 92. Thus, the second discharge pressure P2 in the second oil discharge passage 72 is decreased, and the non-return valve 76 is closed. Accordingly, when the engine rotational speed N is higher than or equal to N2, that is, when rotation of the rotor 20 of the vane oil pump 10 is fast, the second discharged oil having the reduced second discharge pressure P2 is supplied as the back pressure oil to each vane 28 through the second back pressure groove 32 in the entirety of the second pump unit 42 and the oil intake part 40*a* of the first pump unit 40. Thus, the pressing force F that presses the tip end portion of each vane 28 to the inner circumferential cam surface 24 is decreased, and torque loss caused by sliding friction between the vanes 28 and the inner circumferential cam surface 24 is reduced. The engine rotational speed N2 is set such that the engine rotational speed in a low load state such as normal traveling that takes most part during vehicle traveling is higher than N2.

The pressing force F that presses the vanes 28 to the inner circumferential cam surface 24 is affected by not only the back pressure generated by the back pressure oil supplied from the first back pressure groove 30 and the second back pressure groove 32 but also a centrifugal force acting on the vanes 28, the intake negative pressure of oil, the discharge pressure of oil, and the like. In the oil intake parts 40*a*, 42*a* illustrated in the intake step in FIG. 4, a relationship of pressing force F=back pressure+centrifugal force+intake negative pressure is established. In the oil confining parts 40*b*, 42*b* illustrated in the confining step in FIG. 4, a relationship of pressing force F=back pressure+centrifugal force+intake negative pressure−discharge pressure is established. In the oil discharge parts 40*c*, 42*c* illustrated in the discharge step in FIG. 4, a relationship of pressing force F=back pressure+centrifugal force−discharge pressure is established. That is, when the back pressure and the centrifugal force do not change, a relationship of (pressing force F in oil intake part)>(pressing force F in oil confining part)>(pressing force F in oil discharge part) is established, and the pressing force F is the highest in the oil intake parts 40*a*, 42*a*.

In the vane oil pump 10 of the present embodiment, the second back pressure groove 32 is disposed to extend to the oil intake part 40*a* of the first pump unit 40 in which the pressing force F is increased by the intake negative pressure. The second discharged oil having a comparatively low pressure is supplied as the back pressure oil in the oil intake part 40*a* from the second back pressure groove 32. Thus, the pressing force F is decreased, and torque loss caused by sliding friction between the vanes 28 and the inner circumferential cam surface 24 is reduced. Therefore, fuel efficiency is improved. In the present embodiment, the second back pressure groove 32 is disposed about the center line S in an angular range of approximately 240°. In the range, the second discharged oil is supplied as the back pressure oil, and the pressing force F is decreased. Thus, torque loss caused by sliding friction between the vanes 28 and the inner circumferential cam surface 24 is appropriately reduced. In the oil confining part 40*b* and the oil discharge part 40*c* of the first pump unit 40 where the pressing force F is decreased by the discharge pressure (first discharge pressure P1), the first discharged oil having a comparatively high pressure is supplied as the back pressure oil from the first back pressure groove 30. Thus, the vanes 28 are pressed to the inner circumferential cam surface 24 at the appropriate pressing force F regardless of the discharge pressure. Therefore, leakage of oil is reduced, and a predetermined pump efficiency can be secured.

The second back pressure groove 32 is disposed such that the second discharged oil having a comparatively low pressure is supplied as the back pressure oil in the entirety of the second pump unit 42 and the oil intake part 40*a* of the first pump unit 40. Thus, the pressing force F acting on the vanes 28 is decreased in the entirety of the second pump unit 42, and torque loss caused by sliding friction between the vanes 28 and the inner circumferential cam surface 24 is reduced. The oil discharge part 42*c* of the second pump unit 42 in which the pressing force F is decreased by the discharge pressure (second discharge pressure P2) may have an insufficient pressing force that leads to leakage of oil, thereby decreasing the pump efficiency. However, in the case of the hydraulic control device 60 of the present embodiment, the non-return valve 76 is closed in a region of the engine rotational speed N2 or higher where the second discharge pressure P2 is low, and the oil discharged from the second pump unit 42 completely returns to the oil intake passage 68 from the returning oil passage 98 through the pressure adjusting valve 80. Thus, the pump efficiency is not decreased. That is, the second pump unit 42 contributes to a rise in hydraulic pressure at the start of the pump (at the start of the engine). When the pump is started, the pressure adjusting valve 80 is closed and prevents returning of the second discharged oil in the second oil discharge passage 72. Thus, the second discharge pressure P2 rises promptly. The non-return valve 76 is opened and causes the second discharged oil to flow into the first oil discharge passage 70. Thus, the first discharge pressure P1 becomes approximately the same as the second discharge pressure P2. The first discharged oil having the first discharge pressure P1 and the second discharged oil having the second discharge pressure P2 are supplied as the back pressure oil to each vane 28 respectively through the first back pressure groove 30 and the second back pressure groove 32. Accordingly, the vanes 28 are pressed to the inner circumferential cam surface 24 at the predetermined pressing force F. Thus, oil is discharged at a predetermined pump efficiency, and responsiveness to a rise in hydraulic pressure is secured.

While the single pressure adjusting valve 80 adjusts the first discharge pressure P1 and the second discharge pressure P2 in the hydraulic control device 60, the discharge pressures P1, P2 may be adjusted by using individual pressure adjusting valves. While the first discharge pressure P1 is adjusted to the approximately constant controlled hydraulic pressure Pa that is set in accordance with the biasing force of the spring 90, the first discharge pressure P1 can be changed continuously or stepwise by applying a signal pressure to the spool 88 using an electromagnetic valve or the like. Examples of various available forms include employing an electromagnetic pressure adjusting valve having a solenoid (electromagnetic coil) as the pressure adjusting valve 80 to bias the spool 88 with an electromagnetic force, thereby changing the first discharge pressure P1 continuously.

While the embodiment of the present disclosure is heretofore described in detail based on the drawings, the embodiment is merely one embodiment, and the present disclosure can be embodied in various forms having modifications or improvements carried out based on the knowledge of those skilled in the art.

What is claimed is:

1. A vane oil pump comprising:

a rotor including a plurality of slits open on an outer circumferential surface of the rotor;

a housing having an inner circumferential cam surface and accommodating the rotor inside the housing such that the outer circumferential surface of the rotor faces the inner circumferential cam surface, the housing being configured to allow rotation of the rotor with respect to the housing, the inner circumferential cam surface of the housing being configured to have a diameter dimension from a rotational axis of the rotor, and the diameter dimension being configured to increase or decrease in a rotational direction of the rotor such that a first pump unit and a second pump unit taking in and discharging oil in accordance with rotation of the rotor are separately disposed in the rotational direction of the rotor;

a plurality of vanes respectively fitted in the plurality of slits of the rotor, a tip end portion of each of the plurality of vanes being radially disposed to protrude from the opening of each of the plurality of slits of the rotor, and the plurality of vanes being configured to advance or retract with respect to the plurality of slits in a radial direction of the rotor; and a pressure adjusting device configured to adjust a second discharge pressure of the second pump unit to a lower pressure than a first discharge pressure of the first pump unit, wherein a back pressure groove is disposed on the housing, the back pressure groove is provided to supply back pressure oil to a bottom portion of each of the plurality of slits such that the tip end portion of each of the plurality of vanes is pressed to the inner circumferential cam surface, and the back pressure groove is provided such that the back pressure oil supplied to the bottom portion of each of the plurality of slits corresponding to an oil discharge part of the second pump unit has a lower pressure than the back pressure oil supplied to the bottom portion of each of the plurality of slits corresponding to an oil discharge part of the first pump unit when the second discharge pressure is adjusted to a lower pressure than the first discharge pressure.

2. The vane oil pump according to claim 1, wherein:

the back pressure groove includes a first back pressure groove into which first discharged oil of the first pump unit having the first discharge pressure is introduced, and a second back pressure groove into which second discharged oil of the second pump unit having the second discharge pressure is introduced;

the first back pressure groove is provided to supply the back pressure oil to the bottom portion of each of the plurality of slits corresponding to the oil discharge part of the first pump unit; and the second back pressure groove is provided to supply the back pressure oil to the bottom portion of each of the plurality of slits corresponding to an entirety of the second pump unit and an oil intake part of the first pump unit.

3. The vane oil pump according to claim 1, wherein the back pressure groove is provided to supply the back pressure oil to the bottom portion of each of the plurality of slits corresponding to the oil discharge part of the first pump unit.

* * * * *